US005915483A

United States Patent [19]

Gien

[11] Patent Number: 5,915,483

[45] Date of Patent: Jun. 29, 1999

[54] DOWN THE HOLE DRILL

[76] Inventor: Bernard Lionel Gien, P.O. Box 471, Edenvale 1610, South Africa

[21] Appl. No.: 08/745,466

[22] Filed: Nov. 12, 1996

[51] Int. Cl.[6] ..... B25D 9/00

[52] U.S. Cl. ..... 173/91

[58] Field of Search ..... 173/13, 17, 19, 173/91, 128; 175/296, 419

[56] References Cited

U.S. PATENT DOCUMENTS

| | | | |
|---|---|---|---|
| 4,030,554 | 6/1977 | Kammerer, Jr. et al. | 173/17 |
| 4,133,393 | 1/1979 | Richards | 173/17 |
| 4,530,408 | 7/1985 | Toutant | 173/17 |
| 4,790,390 | 12/1988 | Sweeny | 173/17 |
| 4,819,739 | 4/1989 | Fuller | 173/17 |
| 4,936,393 | 6/1990 | Lister | 173/13 |
| 5,113,950 | 5/1992 | Krasnoff | 173/17 |
| 5,277,260 | 1/1994 | Ranck | 173/17 |
| 5,647,445 | 7/1997 | Puchala | 175/296 |
| 5,685,380 | 11/1997 | Purcell et al. | 175/296 |

*Primary Examiner*—Jessica J. Harrison
*Assistant Examiner*—John Paradiso
*Attorney, Agent, or Firm*—McAulay Nissen, Goldberg Kiel & Hand, LLP

[57] ABSTRACT

A down the hole drill in which a larger surface area is provided to which a greater quantity of pressure can be applied. The drill includes a piston and cylinder assembly in which the cylinder is divided in to a plurality of longitudinally extending contiguous sections, and the piston is shaped to provide together with the cylinder a drive and lifting chamber in each sections, and the air supply and exhaust provided in separate passages in a control rod which extends along a bore in the pistons, and a piston head is provided in each section.

4 Claims, 2 Drawing Sheets

DOWN THE HOLE DRILL

FIELD OF THE INVENTION

This invention relates to a down the hole drill and more particularly to the pneumatically operated hammer assembly for drills of this kind.

BACKGROUND OF THE INVENTION

Developments in down the hole drills have taken place over the years to render these drills more and more effective in spite of the very confined space available in the hammer assembly casing for operation of the hammer. The ultimate effectiveness of the hammer is dependant on the surface area over which the pneumatic pressure can be applied.

OBJECT OF THE INVENTION

It is the object of this invention t o provide a larger operational surface area and means for applying more pressure thereto than is presently available for a drill having a hammer of a particular size.

SUMMARY OF THE INVENTION

According to this invention there is provided a down the hole drill comprising a piston and cylinder assembly with the piston forming the drill hammer and powered by an air supply characterised in that the cylinder is divided into a plurality of longitudinally extending contiguous sections and the piston shaped to provide with the cylinder a drive and lifting chamber in each section and the air supply and exhaust provided in separate passages in a control rod which extends along a bore in the piston, the latter providing a piston head in each section of the cylinder.

Further features of this invention provide for there to be an inner wear sleeve in at least one section of the cylinder providing a guide for the piston, the sleeve and piston being arranged to avoid reduction in effective diameter of the piston head in the at least one section of the cylinder.

The invention also provides for the control rod to extend through the entire length of the piston to enable the foot valve normally provided from the drill bit to be eliminated.

BRIEF DESCRIPTION OF THE DRAWINGS

These and other features of this invention will be described below with reference to the accompanying drawings in which.

DETAILED DESCRIPTION OF THE DRAWINGS

Figure 1:
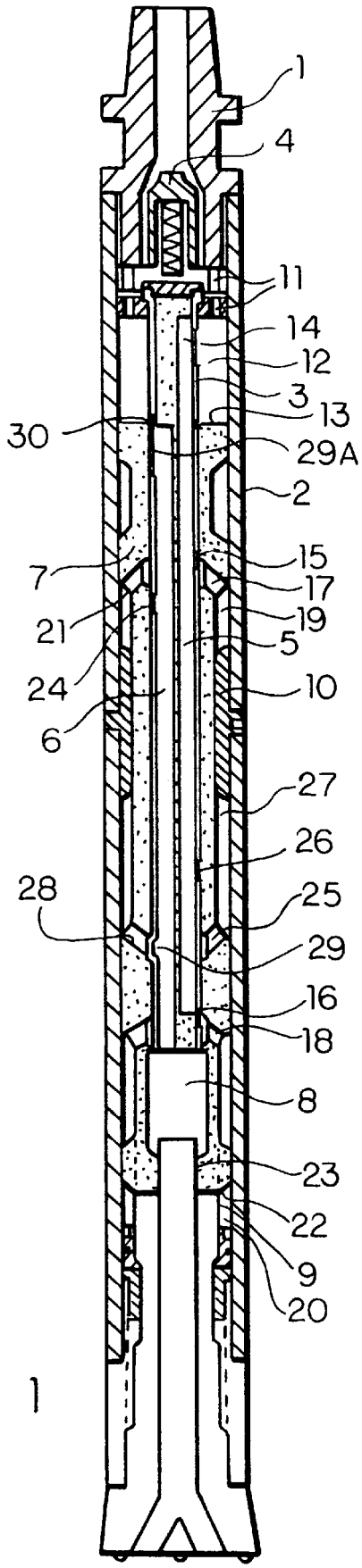
FIG. 1 is a longitudinal section through a drill head.

Referring first to FIG. 1 the drill consists of a backhead (1) fitted to the upper end of a cylinder (2). The backhead (1) provides a connection for an air supply and supports a control rod (3) with a spring loaded check valve (4). The control rod (3) has two longitudinally extending passages (5) and (6). Passage (5) has ports therein to deliver compressed air supplied to the backhead into various chambers provided between the piston (7) and wall of the cylinder (2) while passage (6) provides ports enabling the compressed air to be exhausted from the drill. This is described in more detail below.

The piston (7) which forms the hammer of the assembly is slidable along the control rod (3) and within the cylinder

(2). The piston (7) has a bore (8) therethrough as well as sections of reduced wall diameter to provide the chambers referred to and has ports through the wall to enable compressed air flow between the passages (5) and (6) and the chambers.

A reciprocating and rotating bit assembly (9) is provided in the end of the cylinder (2) and this assembly can be of substantially conventional design. It need not be described in detail here as it forms no part of this invention.

The cylinder (2) is divided into two longitudinal contiguous sections by a partition member (10) and the piston (7) is shaped to provide a drive chamber and lifting chamber in each section.

The operation of the drill under compressed air supply is as follows.

Compressed air enters the drill through the backhead (1) by opening the check valve (4). The air passes through check valve openings (11) and enters chamber (12) where it acts on the end (13) of piston (7). The air also passes through port (14) in control rod (3) to enter passage (5).

The piston (7) is shown in its position with the bit assembly (9) in the raised operative position. In this position ports (15) and (16) from passage (5) are aligned with ports (17) and (18) through the wall of piston (7) opening into chambers (19) and (20). The air pressure there acts on the surfaces (21) and (22). These surfaces (21) and (22) are such that the air provides a greater lifting force thereon than that acting on the end (13) of the piston. Thus the piston is caused to move upwards.

As this lifting takes place ports (15) and (16) are closed. The air in chambers (19) and (20) expands to drive the piston (7) further on its lifting stroke.

When the piston (7) has moved far enough up its upstroke the bore (8) will disengage from the foot valve tube (23) and air in chamber (20) can be exhausted through the bit assembly (9) to atmosphere. At the same time ports (17) align with ports (24) into passage (6) in control rod (3) and chamber (19) can exhaust through passage (6) and bit assembly (9) to atmosphere.

During this movement the piston (7) will have built up sufficient speed for its own inertia to cause it to continue to travel until port (25) through the piston wall aligns with port (26) into passage (5). Chamber (27) is then pressurised and the forces acting on surfaces (13) and (28) will cause the piston movement to reverse and accelerate towards the bit assembly (9). Thereafter ports 25 will align with ports (29) into passage (5) and chamber (27) will exhaust to atmosphere.

When lifting the drill to activate the flushing mode, the bit will drop downwards. The piston (7) will follow the bit assembly (9) and drop to cause port (29A) to be opened above seal (30) in the bore (8) of the piston (7) and compressed air from chamber (12) will flow through port (24) and passage (6) out through the bit assembly (9) to the atmosphere. At the same time ports (15) and (16) in the control rod are closed off by the piston and no air can enter lifting chambers (19) and (20). The piston (7) will therefore be inoperative and the hammer will only flush.

The alternative embodiments illustrated will now be described.

Figure 2:
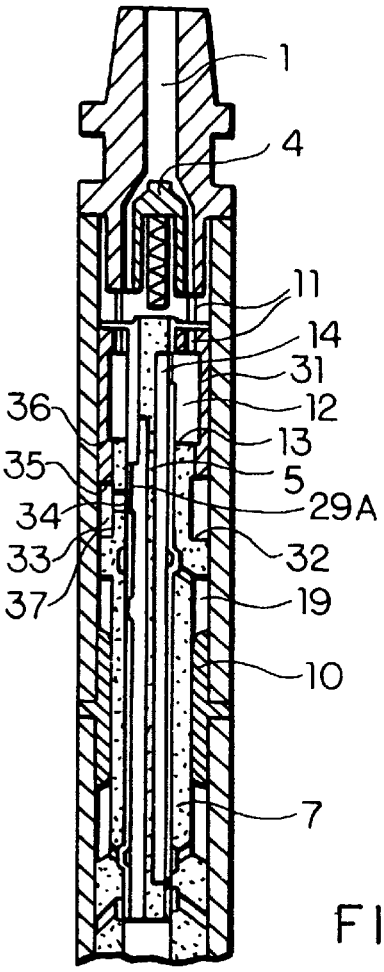
FIGS. 2 to 4 illustrate different embodiments of the invention.

Referring to FIG. 2 only the upper part of the drill assembly is shown. The lower part remains the same as that illustrated in FIG. 1. FIG. 2 shows the inclusion of an inner wear sleeve (31). This is included so that the surface (13) in FIG. 1 is divided into two surfaces (13) and (32).

The advantage of doing this is that it makes the piston (7) lift easier as the area of the combined lifting surfaces of the piston will now be much greater than (13) in FIG. 1. The disadvantage of this construction is that a new chamber (33) is formed and this chamber (33) will exhaust with every cycle of the piston causing the drill to use more air. As can be seen in FIG. 1 chamber (12) never exhausts during the cycling of the piston. The surface area of the drive side of the piston (7) is no different, however, to that in FIG. 1. With the inclusion of chamber (33) an exhaust port and inlet air passage must be created and this is done by having port (34) through the wall of the piston corresponding to port (24) in the control rod. Port (34) will be open to exhaust when the piston (7) approaches the end of the power stroke. It will be closed when the piston moves up and shoulder (35) on the piston passes internal shoulder (36) on the inner sleeve (31) to allow compressed air to flow from chamber (12) to chamber (33) through recess (37) on piston. The combined surfaces (13), (32) and (28) will now cause the piston to move in the power stroke towards the bit. After striking the bit, the cycle is repeated.

Figure 3:
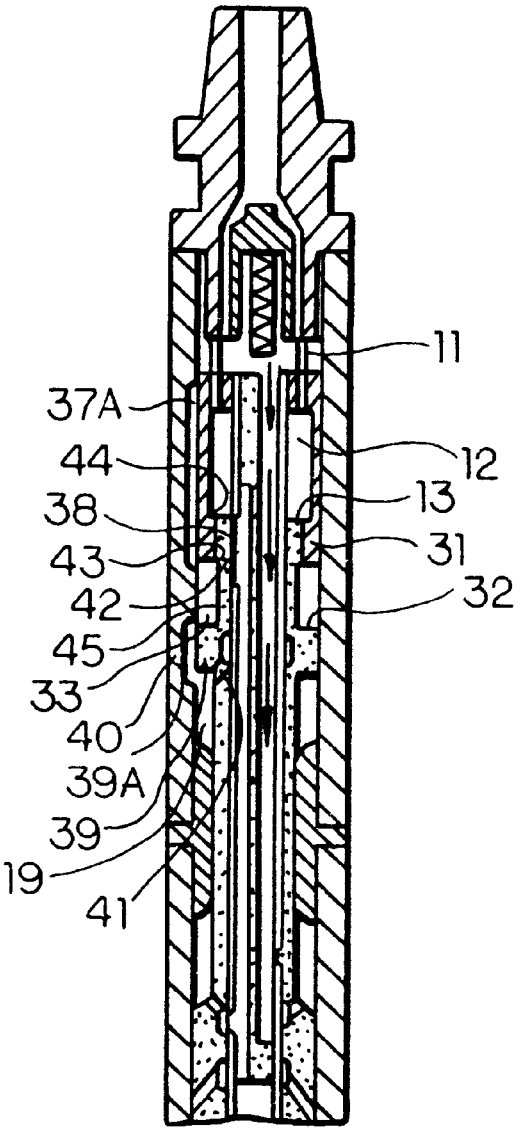

FIG. 3 illustrates a further embodiment in which the inner sleeve (31) can be used. This Figure also shows only the upper piston head with the lower head being identical to that illustrated in FIG. 1.

An air supply passage **(37*a*) is provided for chamber (33). Pressure acts on (32) and the air passes piston head (38) via openings (39*a*) into chamber (19). The piston (7) will now lift until step (39) on piston passes shoulder (40) on the sleeve to shut off air entering chamber (19). The air in chamber (19) will continue expanding until port (41) in the piston corresponds to exhaust port (42) in the control rod and chamber (19) exhausts. Exhaust port (42) which was open to chamber (12), is now closed as the piston keeps travelling up under its own inertia. Shoulder (43) on the piston passes internal shoulder (44) on inner sleeve (31) and air flows from passage (37*a*) via chamber (33) between piston cutout (45) and inner sleeve into chamber (12). The combined pressure on surfaces or surface areas (13), (32) and (28) will cause the piston to move forward to strike the bit. Near the end of the power stroke exhaust port (42) will be uncovered by the bore of the piston and chamber (12)** can exhaust. Compressed air now enters the lifting chamber and the cycle is repeated.

Figure 4:
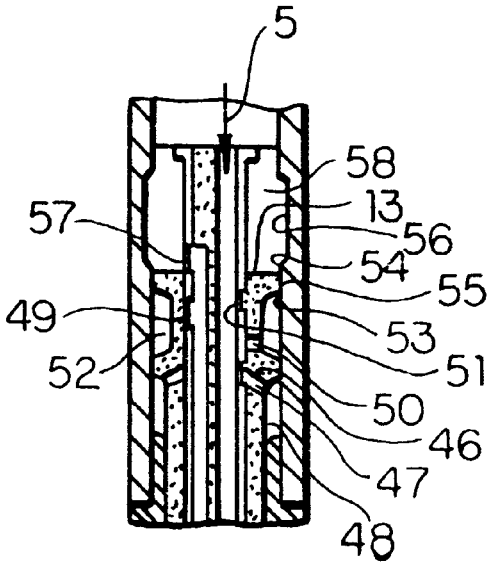

In the embodiment illustrated in FIG. 4, where again the lower assembly is identical to FIG. 1, there is no continuous pressure, during the working cycle, on any of the piston surfaces. Compressed air enters through the backhead and passes check valve (4) to enter passage (5) in control rod (3). As port (46) in control rod is opposite a port (47) in piston (7) to pressurize chamber (48) and port (16) in control rod is opposite port (18) in the piston to pressurize chamber (20), the piston will move up in the return stroke away from the bit assembly (9). As the piston moves up, port (47) will pass port (46) and port (18) will pass port (16) cutting off the compressed air to the lifting chambers. The piston will continue on its upward path and port (47) will correspond with port (49) and bit assembly foot valve tube will pull out of piston bore (8) to allow chambers (48) and (20) to exhaust. The piston continues moving up under its own inertia until port (50) in the piston corresponds with port (51) in the control rod to fill space (52) around the piston head. Shoulder (55) on the piston head passes internal shoulder (54) on the inside of the wear sleeve (31) to allow the air to pass between (55) of the piston head and cutout (56) in the sleeve. Exhaust port (57) is closed off by the piston bore and chamber (58) is now pressurised. The pressure acting on (13) together with the pressure acting on (28) will cause the piston to accelerate towards the bit in the power stroke. Chamber (58) will exhaust through port (57) near the end of the power stroke.

As can be seen in all the various designs, inner chamber (27) (chamber adjacent the partition member) is always filled with compressed air from the control rod (3) through the bore of the piston.

The control rod (3) can go right through into the bore of the bit assembly (9) thus eliminating the use of a foot valve in the bit. The partition member (10) can be in two halves within a single wear sleeve (31) fixed in position by various means.

In the illustrated embodiments half nuts providing a continuous thread are secured to the contiguous lengths of cylinder to form the partition member but obviously alternative assemblies can be used.

Also it will be appreciated that the invention is not confined to two contiguous sections but more sections may be included to form a drill.

I claim:

1. A down the hole drill comprising a pneumatic powered piston and cylinder assembly with (a) the piston forming a drill hammer and the cylinder extending from a backhead at an operatively top of the drill to a drill bit assembly at an operatively bottom of the drill;

(b) the piston being positioned for reciprocating movement within the cylinder and having a bore therethrough;

(c) a control rod extending from the backhead axially down the piston bore and having an air supply passage and an air exhaust passage therein parallel to the axis of the bore;

(d) the cylinder being divided into a plurality of longitudinally extending contiguous sections;

(e) the piston and cylinder being shaped to provide a drive chamber and a lifting chamber between them in each said section with a piston head for the piston in each said section; and (f) ports between the passages in the control rod and the chambers for the supply to and exhaust from each said chamber of air under pressure.

2. A down the hole drill as claimed in claim 1 in which (a) there is an inner wear sleeve in at least one of the sections of the cylinder forming a guide for the piston in that section and (b) the sleeve and piston are shaped to maintain the size of the piston head constant in the cylinder.

3. A down hole drill as claimed in claim 1 in which the control rod extends towards the bottom of the piston adjacent to the drill bit assembly enabling the piston and control rod to operate as a normal foot valve for the drill bit assembly.

4. A down hole drill as claimed in claim 2 in which the control rod extends towards the bottom of the piston adjacent to the drill bit assembly enabling the piston and control rod to operate as a normal foot valve for the drill bit assembly.

* * * * *